US009168636B2

(12) United States Patent
Wald et al.

(10) Patent No.: US 9,168,636 B2
(45) Date of Patent: Oct. 27, 2015

(54) FLEXIBLE ABRASIVE ARTICLE AND METHODS OF MAKING

(75) Inventors: Charles R. Wald, Oakdale, MN (US); Shigeaki Dohgoshi, Machida (JP); Charles J. Studiner, IV, Cottage Grove, MN (US); Jeffrey R. Janssen, Woodbury, MN (US); Michael J. Annen, Hudson, WI (US); Paul D. Graham, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 284 days.

(21) Appl. No.: 13/504,517

(22) PCT Filed: Dec. 13, 2010

(86) PCT No.: PCT/US2010/060008

§ 371 (c)(1),
(2), (4) Date: Apr. 27, 2012

(87) PCT Pub. No.: WO2011/087653

PCT Pub. Date: Jul. 21, 2011

(65) Prior Publication Data

US 2012/0252329 A1 Oct. 4, 2012

Related U.S. Application Data

(60) Provisional application No. 61/289,094, filed on Dec. 22, 2009.

(51) Int. Cl.
*B24D 11/00* (2006.01)
*B24D 3/00* (2006.01)

(52) U.S. Cl.
CPC ..... *B24D 3/00* (2013.01); *B24D 11/001* (2013.01); *B24D 11/008* (2013.01)

(58) Field of Classification Search
USPC ..... 451/56, 443, 527, 548
See application file for complete search history.

(56) References Cited

U.S. PATENT DOCUMENTS 3,270,467 A 9/1966 Block
3,562,968 A 2/1971 Johnson (Continued)

FOREIGN PATENT DOCUMENTS

WO WO 2004/011196 2/2004
WO WO 2006/069179 6/2006

(Continued)

OTHER PUBLICATIONS

International Search Report PCT/US2010/060008 Apr. 29, 2011, 4 pgs.

*Primary Examiner* — Lee D Wilson
*Assistant Examiner* — Shantese McDonald
(74) *Attorney, Agent, or Firm* — Philip P. Soo

(57) ABSTRACT

Provided are abrasive articles having a plurality of elongated channels extending across its working surface and intersecting with each other. These channels provide hinge points that enhance flexibility of the article along two or more directions. Optionally, the abrasive article includes a flexible attachment layer, along with apertures that penetrate through the attachment layer located at the intersection points of the channels. The enhanced flexibility allows the abrasive article to easily access recessed areas of the workpiece and facilitates applying even pressure across convex and concave surfaces. The channels assist in segregating dust particles from the abrading operation, and the optional apertures can be advantageously connected to a vacuum source for evacuation of the dust particles from the channels.

19 Claims, 4 Drawing Sheets

(56) References Cited

U.S. PATENT DOCUMENTS

| | | | | |
|---|---|---|---|---|
| 3,605,349 | A * | 9/1971 | Anthon | 451/534 |
| 3,667,170 | A | 6/1972 | MacKay | |
| 4,539,017 | A * | 9/1985 | Augustin | 51/293 |
| 4,609,581 | A | 9/1986 | Ott | |
| 5,254,194 | A | 10/1993 | Ott | |
| 6,524,681 | B1 * | 2/2003 | Seitz et al. | 428/143 |
| 6,918,821 | B2 * | 7/2005 | Balijepalli et al. | 451/41 |
| 7,344,574 | B2 | 3/2008 | Thurber | |
| 7,438,795 | B2 * | 10/2008 | Wylie et al. | 205/663 |
| 2002/0090901 | A1 | 7/2002 | Schutz | |
| 2003/0036341 | A1 * | 2/2003 | Myoung et al. | 451/41 |
| 2007/0066186 | A1 | 3/2007 | Annen | |
| 2008/0216413 | A1 | 9/2008 | Woo | |
| 2008/0216414 | A1 | 9/2008 | Braunschweig | |
| 2008/0318506 | A1 * | 12/2008 | Brown | 451/539 |

FOREIGN PATENT DOCUMENTS

| | | |
|---|---|---|
| WO | WO 2008/076941 | 6/2008 |
| WO | WO 2008/115648 | 9/2008 |

* cited by examiner

FLEXIBLE ABRASIVE ARTICLE AND METHODS OF MAKING

CROSS REFERENCE TO RELATED APPLICATIONS

This application is a national stage filing under 35 U.S.C. 371 of PCT/US2010/060008, filed Dec. 13, 2010, which claims priority to U.S. Provisional Application Ser. No. 61/289,094, filed Dec. 22, 2009, the disclosure of which is incorporated by reference in their entirety herein.

FIELD OF THE INVENTION

The present disclosure describes abrasive articles and related methods of manufacture. In more detail, the present disclosure describes abrasive articles for removing defects from workpiece surfaces, including painted surfaces, and related methods of manufacture.

BACKGROUND

Consumers have come to expect a glossy, aesthetic exterior finish on new vehicles, such as automobiles and boats. Similar expectations also exist in the aftermarket industry, where vehicles undergo repairs after the exterior of the vehicle has been damaged. Yet achieving a truly aesthetic finish can be daunting. The eye is extremely keen in its ability to spot even the slightest surface defects, which in turn degrade the finish. Manufacturers and repair shops thus demand rigorous systems and methods capable of removing substantially all surface defects to gain customer acceptance. These systems and methods generally use a wide array of specialized abrasive applications.

For example, a typical automotive exterior repair job is a multi-step process involving a series of abrasives having progressively smaller and smaller grain sizes. In a typical procedure, a portion of the panel of an automobile to be repaired is first sanded using a coarse abrasive layer that fully removes any pre-existing paint from the metal surface. The surface is then cleaned and then coated with a suitable body repair material, such a body filler, putty, epoxy resin, or urethane resin. Examples of these body repair materials are described in PCT Application Nos. WO2008115648 (Janssen et al.) and WO2008076941 (Janssen et al.).

Once hardened, the repair material is sanded so that it is flush with the surrounding surface using a progression of abrasives. The sanded area is then coated with a primer layer, typically using a spray gun. After the primer layer is dry, a suitable abrasive is then used to sand the primed surface. The primed surface is then cleaned, and, optionally, surrounding panels are scuffed and a base coat applied with a color that generally matches the rest of the vehicle. A transparent clear coat is then applied over the entire surface of any panels to which base coat was applied. An appropriate abrasive is then used to remove defects such as dirt nibs, dust particles, or excessive orange peel texture. A set of abrasives and/or polishing compounds are then used to remove any sand scratches from the clear coat, and to restore a glossy finish.

There is substantial value to the practitioner in conducting the repair or finishing process as efficiently and as economically as possible. It is further desirable to avoid introducing defects to the workpiece in any of the operations described above. Removal of defects inadvertently introduced by the practitioner can add considerable time to the finishing process.

SUMMARY

One particular issue encountered by practitioners is applying even pressure across the workpiece surface during the abrading operation. Ideally, an abrasive should remove just enough material across the surface such that the surface defects are eliminated. However, conventional coated abrasive layers are generally stiff and do not easily conform to the curved contours of the workpiece surface. As a result, it is common for these abrasives to unduly remove an excess of material along raised portions of the surface while removing too little material in portions which are recessed or have concave contours. As a result, the surface finish may become uneven, or additional time may be required to fully remove all defects or to repair areas where the surface finish was removed unnecessarily. These problems may be alleviated by using thinner, more flexible sheets, but this can impact abrasive performance as well as the robustness of the abrasive layer. Abrasive articles derived from very thin attachment layer materials can also be fragile and may need to be replaced more often.

Another issue is the management of dust, debris, and other fine particles which are generated during the abrading process. These contaminants can build up and become trapped between the abrasive surfaces and the workpiece. If these contaminants are substantial, they can prevent the abrasive from fully contacting the workpiece and adversely affect cut performance. This in turn impacts the efficiency of the abrading operation, leading to higher costs to the practitioner.

The present disclosure addresses these problems by providing an abrasive article having a series of elongated and optionally intersecting channels which extend across the working surface of an abrasive layer and act as hinge points that enhance the flexibility of the article. The abrasive article also includes a flexible attachment layer extending along the back surface of the abrasive layer, which enhances integrity of the article and facilitates coupling the article to a support structure. Optionally, the article further includes apertures that penetrate through the attachment layer, the apertures being located at the intersection points of the channels.

The channels preferably extend across the working surface of the abrasive layer in two or more coplanar directions, and provide sufficient flexibility for the abrasive to access recessed areas of the workpiece and evenly abrade convex and concave workpiece surfaces. As a further advantage, the channels act to segregate debris and dust particles generated by the abrading operation. The apertures, if present, advantageously provide conduits for particle extraction. Particle extraction may be achieved, for example, by connecting the back surface of the article to a vacuum source.

The channels can also improve handling of abrasives that are used in wet or damp sanding applications. Conventional abrasive articles can stick to the surface of the workpiece like a suction cup in wet applications. This phenomenon is called "stiction", and can cause the tool to jerk or move in an uneven manner across the work surface, or even stop entirely. The channels alleviate this problem because they disrupt stiction and provide overall more efficient water and swarf management.

In one aspect, an abrasive article is provided. The abrasive article comprises an abrasive layer having a working surface and a back surface opposite the working surface, a plurality of elongated channels extending across the working surface, and an attachment layer extending across at least a portion of the back surface, the attachment layer being sufficiently flexible for the article to be acutely bendable along the channels.

In another aspect, an abrasive article is provided having a working surface and a back surface opposite the working surface, three sets of generally parallel intersecting channels extending across the working surface and forming an array of equilateral triangles of approximately the same size, the channels having intersection points and further including a plurality of apertures extending through the article at the intersection points, and a flexible attachment layer coupled to the abrasive layer and extending across at least a portion of the back surface.

In still another aspect, a method of making an abrasive article is provided comprising mounting a flexible abrasive layer having a working surface and a back surface onto a converting apparatus, and engraving a pattern of channels into the working surface of the abrasive layer to enhance the flexibility of the article.

DEFINITIONS

As used herein:

"Acutely bendable" means capable of being folded over to form an acute angle (<90°) between opposing surfaces without damage;

"Aperture" refers to an opening in an article which fully penetrates through the article;

"Aperture spacing" refers to the center-to-center distance between two neighboring apertures;

"Back surface" refers to a side of an article that faces away from the workpiece during an abrading operation;

"Channel spacing" refers to the center-to-center distance between two neighboring channels;

"Channel width" refers to the distance across opposing walls of the channel, measured at a depth of 50% the overall depth of the channel;

"Non-woven" refers to a textile structure produced by bonding or interlocking of fibers, or both, accomplished by mechanical, chemical, thermal, or solvent means and combinations thereof; and "Working surface" refers to a side of an article that contacts the workpiece during an abrading operation.

DETAILED DESCRIPTION

Figure 1:
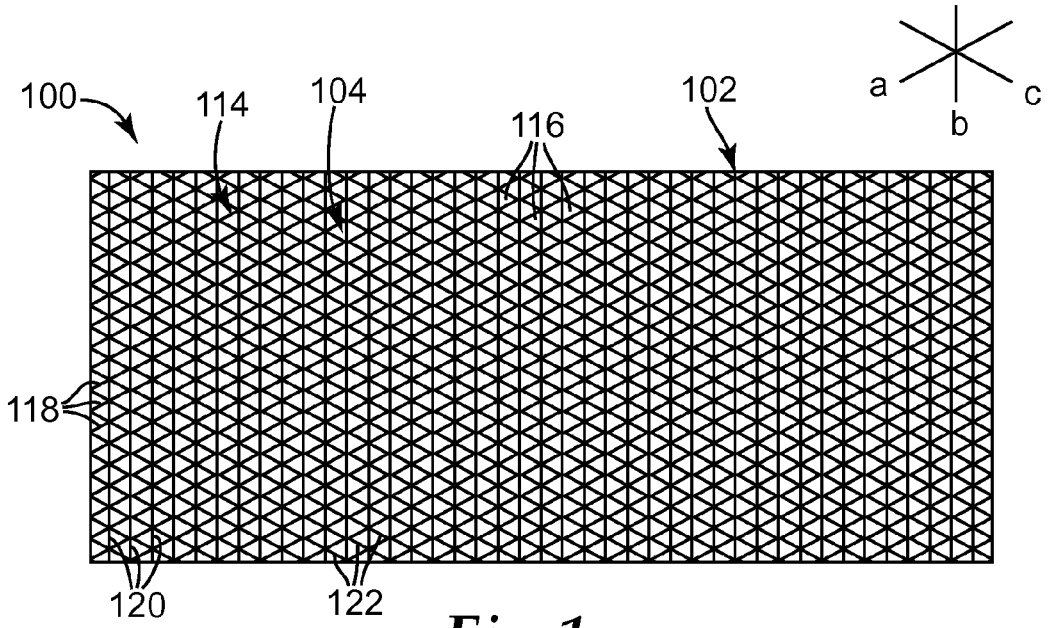
FIG. 1 is a plan view of an abrasive article according to one embodiment of the invention.
Figure 2:
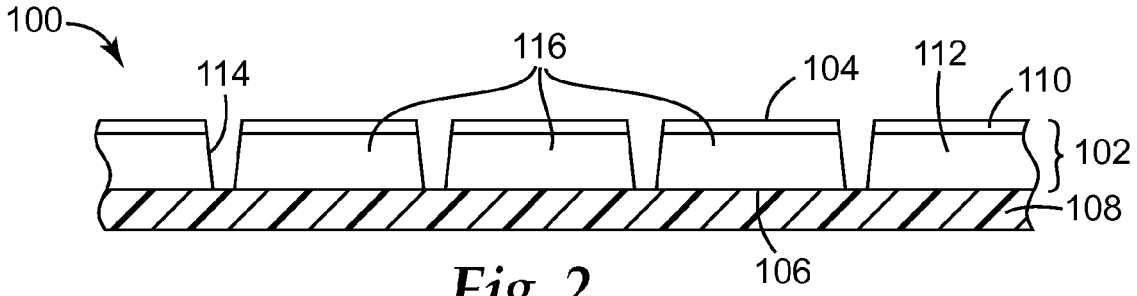
FIG. 2 is a fragmentary cross-sectional side view of the article in FIG. 1.
Figure 3:
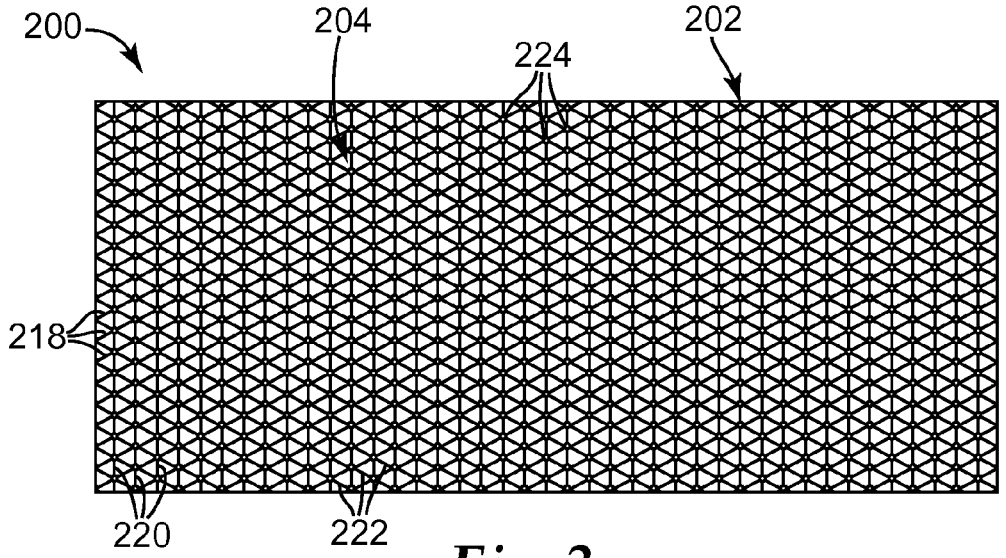
FIG. 3 is a plan view of an abrasive article according to another embodiment of the invention.

An abrasive article according to one exemplary embodiment is shown in FIGS. 1-2 and designated by the numeral 100. As shown by the side view in FIG. 2, the abrasive article 100 includes an abrasive layer 102 having a working surface 104 that faces the workpiece and a back surface 106 opposite the working surface 104. A flexible attachment layer 108 is coupled to the abrasive layer 102, extending across at least a portion of the back surface 106. In some embodiments, the attachment layer 108 and the abrasive layer 102 are adhesively coupled to each other. If desired, other modes of coupling such as mechanical retention may be used alternatively or in combination with the adhesive coupling.

Optionally and as shown, the abrasive layer 102 includes a plurality of layers. As shown in FIG. 2, the abrasive layer 102 includes an abrasive 110 and an underlying base layer 112. In some embodiments, the abrasive 110 is a coated abrasive. Typically, the abrasive 110 and the base layer 112 are laminated to each other but other modes of coupling may also be used. In some embodiments, the abrasive 110 itself has a multilayered construction that includes a make coat, a mineral coat, and a size coat. Optionally, the abrasive 110 further includes an outermost anti-loading layer to improve lubricity of the abrading operation. Additional details concerning the abrasive 110 are described in U.S. Pat. No. 7,344,574 (Thurber et al.) and US Publication No. 2002/0090901 (Schutz et al.).

While not shown, the abrasive layer 102 can also have a single-layered construction. For example, the abrasive layer 102 may be a single polymeric composite layer having uniformly embedded abrasive particles.

The base layer 112 may be formed from a variety of commonly available materials including, for example, sealed coated abrasive backing or a porous, non-sealed backing. Such a backing may be comprised of cloth, vulcanized fiber, paper, nonwoven materials, fibrous reinforced thermoplastic backing, polymeric films, and laminated multilayer combinations thereof. Cloth backings can be untreated, saturated, presized, backsized, porous, or sealed, and they may be woven or stitch bonded. The cloth backings may include fibers or yarns of cotton, polyester, rayon, silk, nylon or blends thereof. The cloth backings can be provided as laminates with different backing materials described herein. Paper backings also can be saturated, barrier coated, presized, backsized, untreated, or fiber-reinforced. The paper backings also can be provided as laminates with a different type of backing material. Nonwoven backings include scrims and may be laminated to different backing materials mentioned herein. The nonwovens may be formed of cellulosic fibers, synthetic fibers or blends thereof. Polymeric backings include polyolefin or polyester films, nylon, SURLYN™ ionomer or other materials that may be hot-melt laminated. The polymeric backings can be provided as blown film, or as laminates of different types of polymeric materials, or laminates of polymeric films with a non-polymeric type of backing material. The foam backing may be a natural sponge material or polyurethane foam and the like. The foam backing also can be laminated to a different type of backing material. The mesh backings can be made of polymeric or metal open-weave scrims.

In some embodiments, attachment layer 108 comprises a layer of pressure sensitive adhesive, typically made by applying a layer of pressure sensitive adhesive to the second major surface of the compressible backing. Useful pressure sensitive adhesives for this layer include, for example, acrylic polymers and copolymers (e.g., polybutyl acrylate), vinyl ethers, e.g., polyvinyl n-butyl ether, vinyl acetate adhesives, alkyd adhesives, rubber adhesives, e.g., natural rubber, synthetic rubber, chlorinated rubber, and mixtures thereof. One preferred pressure sensitive adhesive is an isooctyl acrylate:

acrylic acid copolymer. The pressure sensitive adhesive may be coated out of organic solvent, water or be coated as a hot melt adhesive.

In some embodiments, the attachment system comprises a quick connect mechanical fastener such as, for example, those described in U.S. Pat. No. 3,562,968 (Johnson et al.), U.S. Pat. No. 3,667,170 (Mackay, Jr.), U.S. Pat. No. 3,270,467 (Block et al.) and U.S. Pat. No. 3,562,968 (Block et al.). In some embodiments, the attachment system comprises a loop substrate. The purpose of the loop substrate is to provide a means that the flexible abrasive article can be securely engaged with hooks from a support structure. The loop substrate may be laminated to the coated abrasive backing by any conventional means. The loop substrate may be a chenille stitched loop, a stitchbonded loop substrate or a brushed loop substrate (e.g., brushed nylon). Examples of typical loop backings are further described in U.S. Pat. No. 4,609,581 (Ott) and U.S. Pat. No. 5,254,194 (Ott). The loop substrate may also contain a sealing coat to seal the loop substrate and prevent subsequent coatings from penetrating into the loop substrate.

As illustrated by FIG. 1, a plurality of longitudinal channels 114 extend across the working surface 104 of the abrasive layer 102. In this embodiment, the channels 114 include any and all channels located on the working surface 104. The channels 114 intersect each other and divide the working surface 104 into a generally two-dimensional array of discrete triangular sections 116. Each channel 114 is aligned along one of three precisely defined directions labeled "a", "b", and "c", shown in an inset at the upper right corner of FIG. 1. Directions "a", "b", and "c" are mutually coplanar with the working surface 104, each direction forming a 60° angle with each of the other two directions. The channels 114 include first channels 118, second channels 120, and third channels 122 aligned along the directions "a", "b", and "c", respectively. As shown, each point of intersection is located where one of the first channels 118, one of the second channels 120, and one of the third channels 122 simultaneously cross each other.

Optionally, the channels 118,120,122 located on the working surface 104 have uniform channel spacing. As illustrated in FIG. 1, the sections 116 are of uniform size and shape, each section 116 having the shape of an equilateral triangle. Non-uniform channel spacing may also be used.

The article 100 has a cross-section that is relatively thin along the base of each channel 118,120,122. In this embodiment, the channels 118,120,122 have a uniform channel depth (dimension perpendicular to the plane of the working surface 104) across the working surface 104. The depth of the channels 118,120,122 is sufficiently large to substantially increase the overall flexibility of the article 100 about at least one bending axis, at least two bending axes, or at least three bending axes coplanar with the working surface 104 and aligned with directions "a", "b", and "c", respectively. In some embodiments, the channels 118,120,122 have a depth that is at least 75%, at least 90%, or at least 95% of the overall thickness of the abrasive layer 102.

In the embodiment shown in FIG. 2, the channels 118,120,122 have a depth that is the same as the overall thickness of the abrasive layer 102, such that the bottom walls of the channels 118,120,122 are provided by the attachment layer 108. Under these conditions, the abrasive layer 102 is fragmented into a generally two-dimensional array of discrete "islands" and the integrity of the article 100 is provided solely by the continuous attachment layer 108. Optionally, the channels 118,120,122 can have a depth that exceeds the overall thickness of the abrasive layer 102 such that the channels 118,120,122 partially extend into the attachment layer 108.

The overall flexibility to the article 100 partly depends on the lateral dimension (or diameter) of the sections 116. Overall, smaller sections allow for greater flexibility, since this allows the "hinge points" to be located closer to each other along the working surface 104. However, the channels 118,120,122 also displace a portion of the working surface 104 that might otherwise be used to abrade the workpiece. In theory, for a given channel width, if the sections 116 are too small in size, then there would be reduced contact area between the abrasive and the workpiece surface in the abrading operation. Yet, use of very small sections 116 were nonetheless found to provide unexpectedly high rates of cut. Preferably, the sections 116 have a lateral dimension ranging from 1 millimeter to 15 millimeters, more preferably from 1.5 millimeters to 7 millimeters, and most preferably from 2 millimeters to 5 millimeters.

As shown, the channels 118,120,122 have a geometry that allows the article 100 to easily bend along respective directions "a", "b", and "c". Preferably, the channels 118,120,122 have a channel width sufficient to impart flexibility but not so large that there is a significant reduction in the total working surface 104. Preferably, the ratio of the lateral dimension of the sections 116 to channel width ranges from 4 to 16, more preferably from 6 to 14, and most preferably from 8 to 12. If desired, the channel side walls may be tapered or otherwise non-vertical as shown in FIG. 2 to further enhance flexibility.

Figure 7:
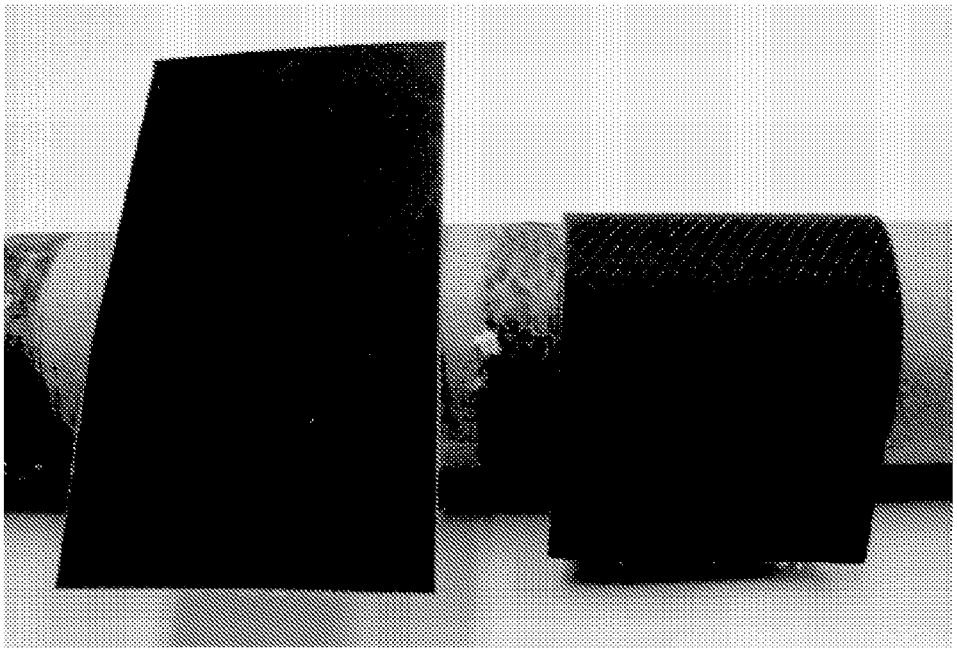
FIG. 7 is a photograph showing a perspective view of the article in FIGS. 4-6 and a preform of the same article draped over a curved surface and compared side-to-side.

In further embodiments, the channels 118,120,122 may have depths that vary depending on the channel orientation. Such a configuration can advantageously provide anisotropic properties where the article 100 is tailored to have greater bending flexibility along some directions than along others. For example, the abrasive article 100 can be optionally customized to have enhanced flexibility along only one direction to facilitate mounting the attachment layer 108 to a cylindrical or semi-cylindrical support structure. In some embodiments, the flexible attachment layer 108 also has "dead soft", or cloth-like, properties allowing the article 100 to sag under its own weight and conform to the contours of the underlying support structure. These characteristics are seen in the exemplary abrasive article shown in FIG. 7.

In addition to being flexible, the attachment layer 108 should also have the robustness (or toughness) to be stretched, compressed, folded, or otherwise distorted in shape without significant damage. In some embodiments, the attachment layer 108 has sufficiently flexibility and toughness that the article 100 is acutely bendable along any of the channels 118,120,122 with the application of external force without compromising the integrity of the article 100. As another option, the attachment layer 108 can be made from a resilient material that allows the article 100 to spring back toward its original, relaxed configuration once the external force is removed.

Besides providing article 100 with enhanced flexibility and conformability to non-planar workpiece surfaces, the channels 118,120,122 also provide vessels that allow dust and other particles to be conveyed away from the working surfaces 104 and segregated such that they do not interfere with the abrading operation. This is especially advantageous when a significant amount of particulate matter is generated as a result of the abrading operation itself, either from the abrasive layer or the workpiece. If the article 100 is used in any wet sanding applications, the channels 118,120,122 can also act as reservoirs for retaining and transporting the liquid during the abrading process, thereby reducing stiction between the article 100 and the workpiece surface.

As a further advantage, the attachment layer 108 material can have a structure that facilitates coupling the abrasive article 100 to a mechanically driven support structure (i.e. a power tool). In the example shown in FIG. 2, the attachment layer 108 includes one-half of a hook and loop attachment system, where the other half is disposed on a plate affixed to the power tool. Such an attachment system secures the article 100 to the power tool while allowing convenient attachment and removal of pads between abrading operations.

Figure 4:
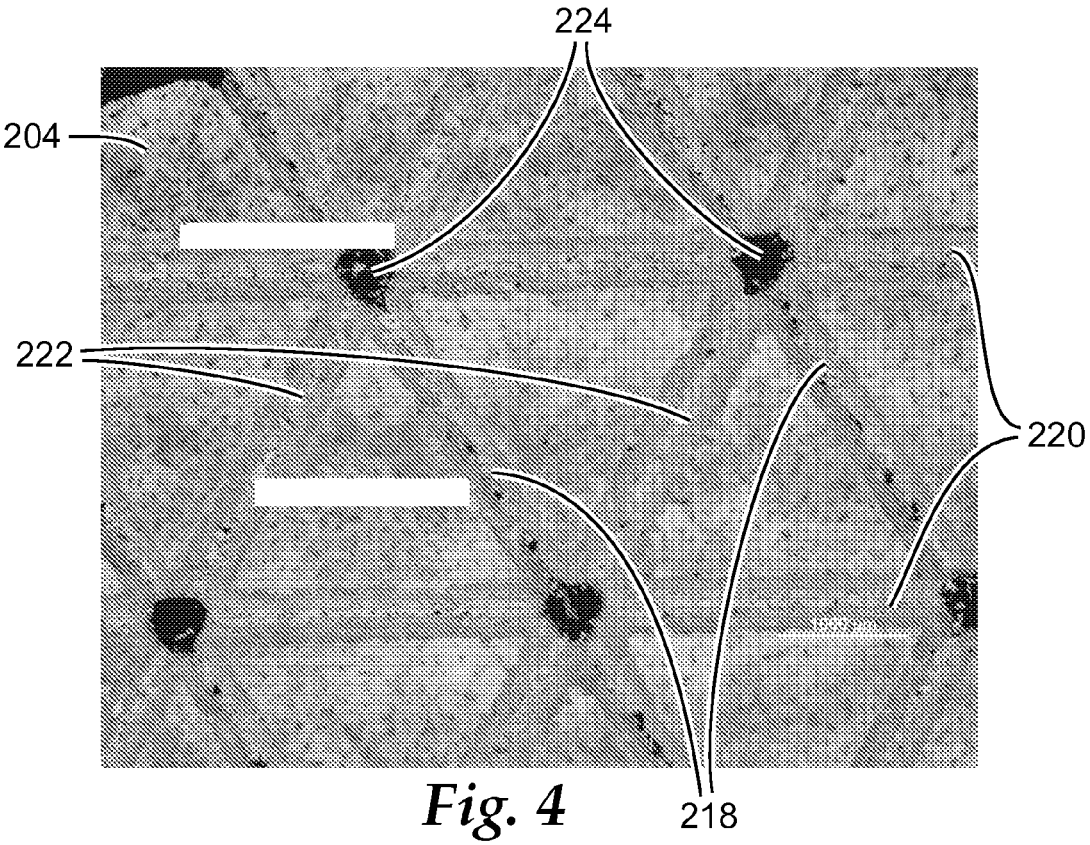
FIG. 4 is a photograph showing an enlarged plan view of a prototype of the article in FIG. 3.
Figure 5:
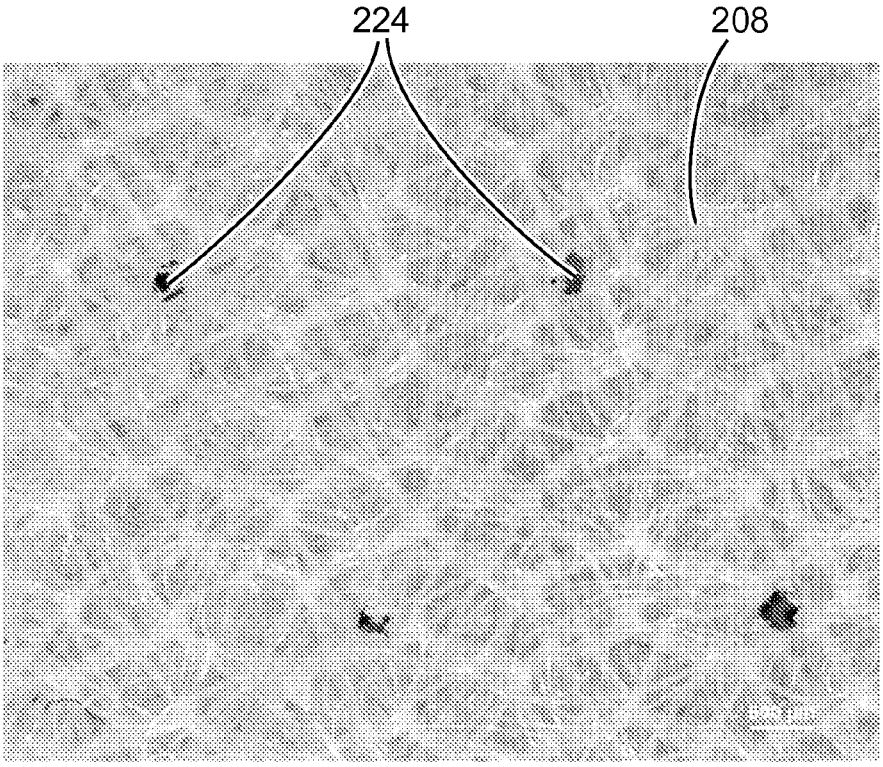
FIG. 5 is a photograph showing an enlarged view of the article in FIG. 4 but showing the surface opposite the surface shown in FIG. 4.
Figure 6:
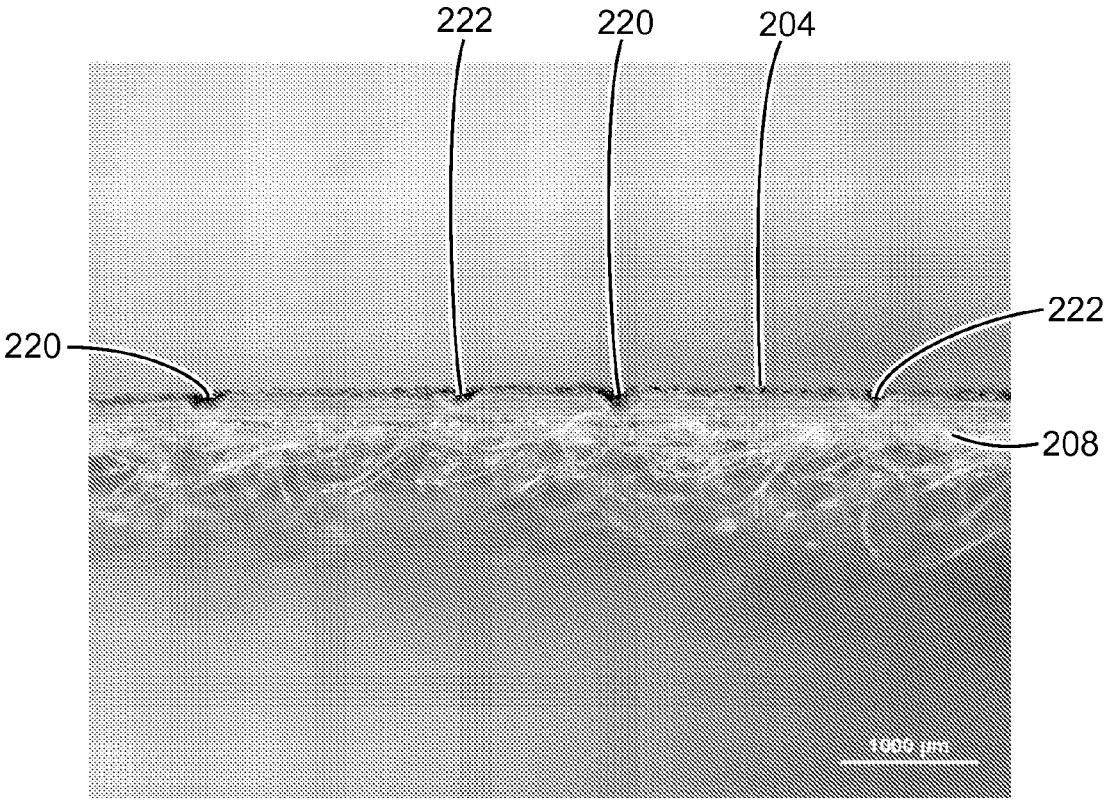
FIG. 6 is a photograph showing an enlarged cross-sectional side view of the article in FIGS. 4-5.

An abrasive article 200 with additional advantageous features according to another embodiment is illustrated in FIGS. 3-6 in top, bottom, and cross-sectional views. The article 200 is similar in many respects to article 100 in that it includes an abrasive layer 202 with a working surface 204, and has a series of intersecting channels 218,220,222 traversing its working surface. However, the article 200 differs from the article 100 in that the article 200 further includes apertures 224 located at the intersections of the channels 218,220,222. FIGS. 4 and 5 show the apertures 224 in more detail. As shown in FIGS. 4 and 5, the apertures 224 extend completely through the article 200 and allow communication between the working surface 204 and the opposite facing surface of the attachment layer 208.

The apertures 224 advantageously provide conduits through which dust and other undesirable particles can be evacuated away from the working surface 204 of the article 200. In some embodiments, this is facilitated by connecting the attachment layer 208 to a vacuum source. Optionally, an inline filtration system may also be used in combination with the vacuum source to sequester the particles and prevent them from becoming airborne. The dust extraction process is preferably conducted concurrently with the abrading operation, whereby dust is not only evacuated from the working surface 204 but also kept away from the operator. The apertures 224 are also advantageously located. Each aperture 224 evacuates particles from six different directions along the channels 118, 120,122, providing highly efficient particle removal with essentially no dead zones.

The apertures 224 can provides other advantages as well. For example, the apertures 224 can be used to conveniently inject a processing fluid through the attachment layer 208 and into the regions between the working surface 204 and the workpiece. Advantageously, the apertures 224 allow fluid to be injected even while maintaining contact between the article 100 and the workpiece, thereby facilitating an efficient abrading operation. If the practitioner elects not to use a fluid, the apertures 224 alternatively serve to allow air or gas to flow through into these regions and provide cooling during an abrading operation. Other aspects of the article 200 are similar to those of article 100 and shall not be repeated.

Figure 8:
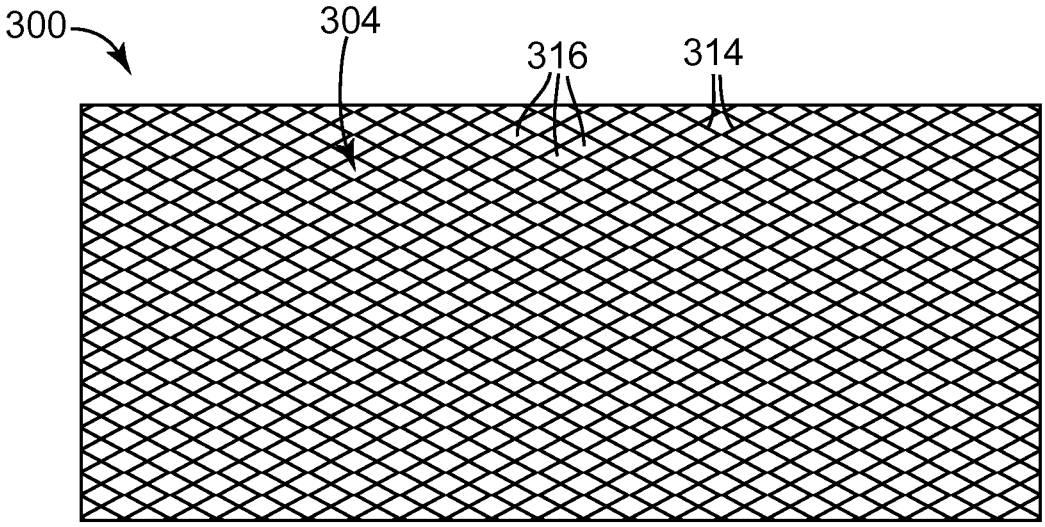
FIG. 8 is a plan view of an abrasive article according to still another embodiment of the invention.

FIG. 8 provides an abrasive article 300 according to another embodiment. The article 300 has a working surface 304 divided by channels 314 into a two-dimensional array of sections 316. Unlike the articles 100,200 previously described, the article 300 has channels 314 are aligned along only two directions. As a result of this configuration of channels 314, the sections 316 have a rhomboid shape rather than a triangular shape. As shown, each intersection point is located at the crossing of two channels 314.

Figure 9:
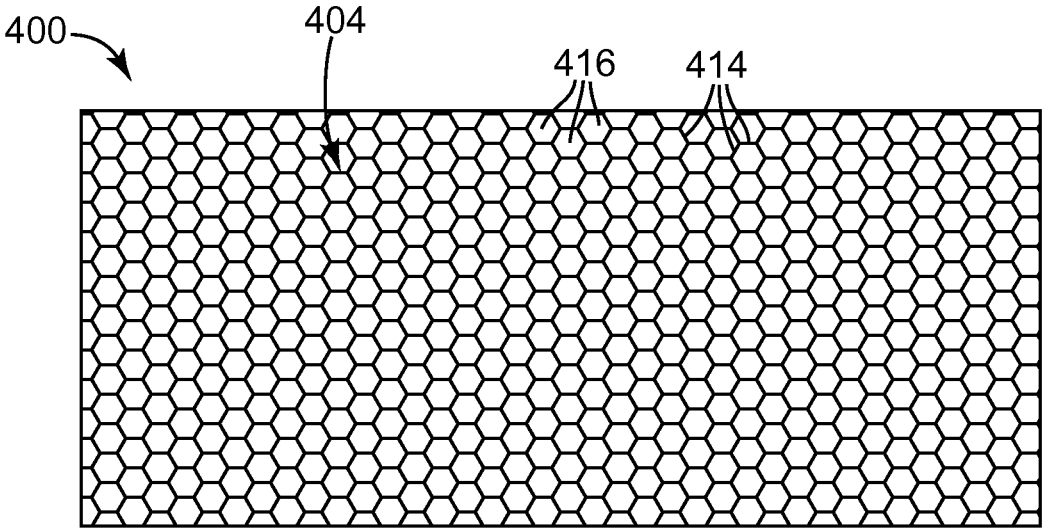
FIG. 9 is a plan view of an abrasive article according to yet another embodiment of the invention.

FIG. 9 provides an abrasive article 400 according to still another embodiment, in which intersecting channels 414 extend across a working surface 404 to create a two-dimensional array of hexagonal sections 416. Unlike the previous abrasive articles described, the channels 414 form a tortuous network with many intersection points. As shown, each intersection point is located where three channels 414 intersect. It is to be understood that sections assuming the shape of polygons other than triangles, rhomboids, and hexagons can be used to provide similar advantages to those already described.

Other embodiments do not include an organized polygonal pattern. Moreover, the channels need not extend along straight paths. Abrasive articles having channels with curved or undulating paths are contemplated and within the scope of this disclosure. Moreover, combinations of straight and curved channels can also be used—for example, the working surface may include a series of concentric circular channels that intersect with radial channels emanating from a single central point. As another alternative, a series of channels having a randomized pattern may also be used, where the spacing between channels and/or relative orientation of the channels varies across the working surface of the article. The channel pattern optionally includes some channels that do not intersect with any other channels.

The abrasive articles described above can be made using a laser conversion process similar to that described in U.S. Patent Publication No. 2008/0216414 (Braunschweig et al.). In one exemplary method, a virgin abrasive layer is first provided. The abrasive layer of this disclosure can be made by known manufacturing processes. The sheet is coupled to an attachment layer to provide a preform, which is subsequently mounted to a laser converting apparatus. The converting apparatus then uses laser energy to engrave a two-dimensional array of intersecting channels into the working surface of the abrasive layer. Optionally, the engraving operation is automatic or semi-automatic, and accepts user input prior to the operation to define a channel pattern to be engraved. The pattern may be uploaded to the converting apparatus in a digital format, such as in a computer-aided design (CAD) file.

The laser used for converting the abrasive article may be any suitable conventional laser. Examples of suitable lasers include gas lasers, chemical lasers, excimer lasers, and solid state lasers. While many laser types may be suitable for the converting of the abrasive articles described herein, low density gain media lasers such as a molecular gas lasers, known as a carbon dioxide lasers, are particularly useful.

The use of a laser presents particular advantages. First, lasers can be precisely controlled. For example, the intensity and the width of the laser beam can be tailored to define the respective depth and width of the channels. Second, the cutting action of the laser is cumulative in the manner in which it removes material from the abrasive article. When the path of the laser passes through a location on the abrasive layer that has already been cut one or more times, the overall depth of the cut is increased at that location. This aspect can be exploited to create apertures for dust extraction as described earlier. As shown in FIG. 4, each intersection point is located where three laser-induced cuts overlapped, thereby resulting in apertures 224 that communicate with both the working surface 204 and opposite facing surface of the attachment layer 208.

Optionally, some or all of the apertures 224 may be formed using conventional laser conversion methods. For example, a laser engraving the abrasive layer 202 could be directed toward one or more locations to specifically drill or cut one or more apertures 224. Apertures created using this method would of course not be limited by the locations of the channels 218,220,222.

As another possibility, conventional die cutting methods can be used to create the channel and aperture patterns described. For example, an etching and milling process can be used to form specialized dies having the fidelity and the detail needed for this application. The cutting process could be a kiss cutting process where the cut does penetrate through the attachment layer 108. One such technology is called thin plate flexible die technology and is available from Mathias Die in St. Paul, Minn.

EXAMPLES

Unless otherwise noted, all reagents were obtained or are available from Aldrich Chemical Co., Milwaukee, Wis., or may be synthesized by known methods. Unless otherwise noted, all parts, percentages, ratios, etc. in the Examples and the rest of the specification are by weight.

The following abbreviations are used to describe the examples:

rpm: revolutions per minute
mil: thousandths of an inch
psi: pounds per square inch
UV ultraviolet "ACR-1" refers to 2-phenoxyethyl acrylate, commercially available under the trade designation "SR339" from Sartomer Co. of Exton, Pa.

"ACR-2" refers to trimethylolpropane triacrylate, commercially available under the trade designation "SR351" from Sartomer Company.

"ACR-3" refers to an aromatic polyester based urethane diacrylate that is blended with 25% isobornyl acrylate, commercially available under the trade designation "CN973J75" from Sartomer Company.

"BC1" refers to a styrene-isoprene-styrene block copolymer available under the trade designation "KRATON D1161K" from Kraton Polymers, Houston, Tex.

"BC2" refers to a hydrocarbon resin commercially available under the trade designation "WINGTACK EXTRA" from Goodyear Tire and Rubber Company, Akron, Ohio.

"BC3" refers to dilauryl thiodipropionate antioxidant, commercially available under the trade designation "ARENOX DL" from Reagens S.p.A, Italy.

"BC4" refers to a monofunctional hindered phenolic anitoxidant, commercially available under the trade designation "Irganox 1076" from Ciba in Basel, Switzerland.

"CPA" refers to gamma-methacryloxypropyltrimethoxysilane, commercially available under the trade designation "A-174" from Crompton Corp. of Middlebury, Conn.

"DSP" refers to an anionic polyester dispersant, commercially available under the trade designation "SOLPLUS D520" from Lubrizol Corp., Wickliffe, Ohio.

"FIL" refers to fumed silica, commercially available under the trade designation "OX-50" from The Cary Company of Addison, Ill.

"MIN-1" refers to green silicon carbide mineral, D50=14.7 micrometers, commercially available under the trade designation "GC 800 GREEN SILICON CARBIDE" from Fujimi Corp., Tualatin, Oreg.

"MIN-2" refers to green silicon carbide mineral, D50=9.9 micrometers, commercially available under the trade designation "GC 1200 GREEN SILICON CARBIDE" from Fujimi Corp.

"PP" refers to a purple pigment commercially available under the trade designation "PRODUCT CODE 9S93" from Penn Color, Doylestown, Pa.

"UVI" refers to acylphosphine oxide, commercially available under the trade designation "LUCERIN TPO-L" from BASF Corp. of Florham Park, N.J.

Comparative A

An abrasive slurry was prepared by homogenously dispersing the composition listed in Table 1 for approximately 60 minutes using a laboratory mixer with a Cowles blade. This slurry was applied to a 12 inch (30.5 centimeter) wide microreplicated polypropylene tooling having the repeating pattern as shown in FIGS. 7a, 7b, and 7c of U.S. Published Patent Application No. 2007/0066186 (Annen et al.), with a coating weight of approximately 5.5 milligrams/square centimeter. The dimensions corresponding to each of the features shown in the figures are: 701 (406 micrometers), 702 (58 micrometers), 704 (363 micrometers), 707 (178 micrometers), and 705 (58 micrometers). The angles that are shown in the figures are: 710 (34.0°), 720 (34.0°), 703 (47.9°), 706 (76.85°). The slurry filled polypropylene tooling was then contacted in a nip roll to the UV cured tie-coated surface of a 1 mil (25.4 micrometers) thermoplastic polyurethane film, commercially available under the trade designation "ESTANE 58887 NAT021" from Lubrizol Corp., according to the composition listed in Table 1. The polyurethane film was supported on a 68 pound (30.85 kilogram) dual-sided polypropylene coated paper liner with a basis weight of 111 grams per square meter, a polypropylene coating weight of 17.0 grams per square meter on each side, available under the trade designation "MUL-B/C" from Felix Schoeller Technical Papers, Inc., Pulaski, N.Y. The abrasive slurry-filled tooling was UV cured using a UV lamp, type "D" bulb, from Fusion Systems Inc., Gaithersburg, Md., at 600 watts per inch (236 watts/centimeter), and a line speed of 21.3 meters per minute. The tooling removed to expose a tetrahedral microreplicated abrasive coating having the dimensions enumerated above.

A 52 grams/square meter brushed nylon loop fabric, available under the trade designation "DAYTON BRUSHED NYLON", from Sitip SpA, Cene, Italy, was laminated to a 3.0 mil (76.2 micrometer) polyester film, available under the trade designation "HOSTAPHAN 2262", from Mitsubishi Polyester Film, Inc., Greer, S.C., using a hot melt rubber adhesive consisting of a blend of 49.5 parts by weight BC1, 49.5 parts by weight BC2, 0.5 parts by weight BC3, and 0.5 parts by weight BC4. The film side of the laminate was then bonded to a 90 mil (2.29 millimeter) layer of open cell polyurethane foam, available under the trade designation "R600U", from Pinta Foamtec, Minneapolis, Minn., by means of a pressure sensitive adhesive (PSA) transfer tape, commercially available under the trade designation "9453LE", from 3M Company. The paper liner was removed from the abrasive coated polyurethane film and the film then bonded to the non-loop face of the polyurethane foam laminate using another layer of the PSA transfer tape.

Thus, the resulting abrasive article comprised the following layers: a microreplicated abrasive; a tie-coated 1 mil (25.4 micrometer) thermoplastic polyurethane film; a PSA transfer tape; a 90 mil (2.29 millimeter) polyurethane foam; a PSA transfer tape; a 3.0 mil (76.2 micrometer) polyester film; a hot melt rubber adhesive; and a brushed nylon loop fabric.

A 6 inch (15.4 centimeter) diameter abrasive disc was then die-cut from this construction.

Comparative B

A 6 inch (15.4 centimeter) diameter abrasive disc was prepared according to the method described in Comparative A, per the abrasive slurry and tie-coat compositions listed in Table 1, wherein the abrasive slurry was applied to the tie-coated surface of a 5.0 mil (127 micrometer) version of the "HOSTAPHAN" polyester film, the film having the brushed nylon loop laminated to the opposing surface using the hot melt rubber adhesive.

Thus, the resulting abrasive article comprised the following layers: a microreplicated abrasive; a tie-coated 5.0 mil (127 micrometer) polyester film; a hot melt rubber adhesive; and a brushed nylon loop fabric.

TABLE 1

| Component | Comparative A Abrasive Slurry | Comparative A Tie-Coat | Comparative B Abrasive Slurry | Comparative B Tie-Coat |
|---|---|---|---|---|
| ACR-1 | 17.1 | 33.0 | 17.1 | 32.8 |
| ACR-2 | 17.1 | 0 | 17.1 | 0 |
| ACR-3 | 0 | 65.0 | 0 | 64.7 |
| CPA | 3.0 | 0 | 3.0 | 0 |
| DSP | 4.0 | 0 | 4.0 | 0 |
| FIL | 0.75 | 0 | 0.75 | 0 |
| MIN-1 | 57.0 | 0 | 0 | 0 |
| MIN-2 | 0 | 0 | 57.0 | 0 |
| PP | 0 | 0 | 0.21 | 0.5 |
| UVI | 1.0 | 2.0 | 1.0 | 2.0 |

Example 1

A series of three intersecting channels, each offset by 60 degrees, were laser cut into the abrasive coating and backing of a Comparative A disc, to form an equilateral triangular array. Array dimensions and laser cutting conditions, using an EAGLE carbon dioxide Laser, model number "500", from LMI Technologies, Royal Oak, Mich., are listed in Table 2.

Example 2

A series of three intersecting channels, each offset by 60 degrees, were laser cut into the abrasive coating and backing of a Comparative B disc, to form an equilateral triangular array. Array dimensions and laser cutting conditions, using the EAGLE carbon dioxide Laser, are listed in Table 2.

TABLE 2

| | Example 1 | Example 2 |
|---|---|---|
| Dimensions | | |
| Width (micrometers) | 642 | 430 |
| Internal Triangular Dimensions (millimeters) | 5 × 5 × 5 | 5 × 5 × 5 |
| Laser Settings | | |
| Power (%) | 240 watts | 240 watts |
| Average Beam Diameter (millimeters) | 10 mils | 10 mils |
| Mark Speed (centimeters/second) | 114 | 228 |
| No. of Beam Sweeps | 1 | 1 |

Cut and Finish Test

Abrasive performance testing was performed on an 18 inch by 24 inch (45.7 centimeter by 61 centimeter) black painted cold roll steel test panels having "RK8148" type clear coat, obtained from ACT Laboratories, Inc., Hillsdale, Mich. Sanding was performed using a random orbit sander, model number "57502" obtained from Dynabrade, Inc., Clarence, N.Y., operating at a line pressure of 40 psi (275.8 kilopascal), as measured at the inlet port of the tool. For testing purposes, the abrasive discs were attached to a 6 inch (15.2 centimeter) interface pad, which was then attached to a 6 inch (15.2 centimeter) backup pad, both commercially available under the trade designations "HOOKIT INTERFACE PAD, PART NO. 05777" and "HOOKIT BACKUP PAD, PART NO. 05551", from 3M Company.

Each test panel was divided into four 18 inch (45.7 centimeter) long lanes, each lane being 6 inches (15.2 centimeters) wide. Each abrasive disc was tested by damp-sanding with water for 30 seconds in a single lane. The test panel was dried and weighed before and after sanding each lane. The difference in mass is the measured cut, reported as grams per 30 seconds. The average surface finish (R.sub.z) after sanding each lane was measured using a profilometer available under the trade designation "SURTRONIC 3+ PROFILOMETER" from Taylor Hobson, Inc., Leicester, England. R.sub.z is the average of 5 individual measurements of the vertical distance between the highest point and the lowest point over the sample length of an individual profilometer measurement. Five finish measurements were made per lane. Three abrasive discs were tested per each Comparative and Example. Results are listed in Table 3.

TABLE 3

| Sample | Cut (grams) | Average Finish R.sub.z (micrometers) | Handling Characteristics |
|---|---|---|---|
| Comparative A | 0.27 | 1.88 | Disc "grabbed" onto test panel |
| Example 1 | 0.29 | 1.32 | Disc ran smoothly over test panel |
| Comparative B | 0.26 | 1.00 | Disc "grabbed" onto test panel |
| Example 2 | 0.24 | 0.99 | Disc ran smoothly over test panel |

Comparative C

A 9 inch by 11 inch (22.86 centimeter by 27.94 centimeter) sheet of P320 grade "A" weight coated abrasive, commercially available under the trade designation "3M IMPERIAL WETORDRY SHEETS", obtained from 3M Company, was laminated on the non-abrasive side with a double-sided adhesive tape, type "300 LSE DUAL SIDED PSA", also from 3M company. A mechanical fastener type nylon loop material, 70 grams per square meter, available under the trade designation "DAYTONA BRUSHED NYLON LOOP", from Sitip S.p.A., was then laminated to the adhesive tape.

Example 3

A series of three intersecting channels, each offset by 30 degrees, were laser cut into the abrasive coating and backing of a Comparative B disc, to form an equilateral triangular array. Array dimensions and laser cutting conditions, using a carbon dioxide laser, model number "DIAMOND E-400", from Coherent, Inc., Santa Clara, Calif., are listed in Table 4.

TABLE 4

| | Example 3 |
|---|---|
| Dimensions | |
| Width (micrometers) | 377 |
| Internal Triangular Dimensions (millimeters) | 2.3 |
| Laser Settings | |
| Power (%) | 50 (510 watts) |
| Average Beam Diameter (millimeters) | 0.25 |
| Mark Speed (centimeters/second) | 200 |
| No. of Beam Sweeps | 1 |
| Frequency (kilohertz) | 20 |

Comparative C and Example 3 were then evaluated for flexibility and sanding performance according to the Drape Test and the Cut and Finish Test.

Drape Test

A 6 inch diameter (15.2 centimeters) disc was die-cut from the 9 inch by 11 inch (22.86 centimeter by 27.94 centimeter) abrasive layer. The disc was then draped evenly over a 13 millimeter stainless steel bar and the distance between opposing edges measured. The more flexible the disc, the shorter the distance between the opposed edges.

Cut and Finish Test

Abrasive performance testing was performed on a preweighed 18 inch by 24 inch (45.7 centimeter by 61 centimeter) cold roll steel test panels having "SIKKENS 393719" primer coat, obtained from ACT Laboratories, Inc.

A 2.25 inch by 4.25 inch (5.72 centimeter by 10.80 centimeter) rectangular sample was die-cut from the 9 inch by 11 inch (22.86 centimeter by 27.94 centimeter) abrasive layer and attached to an equally sized soft foam back-up pad, commercially available under the trade designation "SUPER ASSILEX PAD M, PART NO. 971-0025", from Eagle Abrasives, Norcross, Ga. The foam back up pad was secured to an equally sized 2.0 kilogram metal back up pad with a double sided adhesive tape, type "300 LSE DUAL SIDED PSA", from 3M company. The test panel was flooded with water and the abrasive sample/back up pad assembly reciprocated for 150 strokes against the panel. A stroke was defined as the movement of the operator's hand in a back and forth motion in a straight line. After abrading the test sample the panel was rinsed with water and a wet sponge, dried and reweighed. The difference in mass between before and after abrading is the cut, reported in grams. The average surface finish (R.sub.z) in micrometers was measured using the "SURTRONIC 25 PROFILOMETER". Three finish measurements were made per test sheet, and three abrasive layers were tested per each Comparative and Example. Results are listed in Table 5.

TABLE 5

| Sample | Cut (grams) | Average Finish (micrometers) | Drape (centimeters) | Handling Characteristics |
|---|---|---|---|---|
| Comparative C | 2.47 | 5.90 | 15.2 | Disc "grabbed" onto test panel |
| Example 3 | 1.28 | 4.37 | 7.2 | Disc ran smoothly over test panel |

All of the patents and patent applications mentioned above are hereby expressly incorporated by reference. The embodiments described above are illustrative of the present invention and other constructions are also possible. Accordingly, the present invention should not be deemed limited to the embodiments described in detail above and shown in the accompanying drawings, but instead only by a fair scope of the claims that follow along with their equivalents.

The invention claimed is:

1. An abrasive article comprising:

an abrasive layer having a working surface and a back surface opposite the working surface, wherein the abrasive layer comprises a backing and an abrasive laminated to the backing;

a plurality of elongated channels extending across the working surface; and an attachment layer coupled to at least a portion of the back surface, the attachment layer being sufficiently flexible for the article to be acutely bendable along the channels, wherein the channels have a depth that is at least 75% of the overall thickness of the abrasive layer.

2. The abrasive article of claim 1, wherein the channels intersect with each other, thereby dividing the working surface into an array of discrete sections.

3. The abrasive article of claim 2, wherein the sections are triangular.

4. The abrasive article of claim 2, wherein the sections have a lateral dimension ranging from 1 millimeter to 15 millimeters.

5. The abrasive article of claim 4, wherein the channels have a certain width and the ratio of the lateral dimension of the sections to the certain width ranges from 4 to 16.

6. The abrasive article of claim 2, wherein the plurality of channels comprises at least three intersecting sets of channels, the channels of each set being generally parallel to each other.

7. The abrasive article of claim 2, wherein the channels of each set have a generally uniform channel spacing.

8. The abrasive article of claim 2, further comprising a plurality of apertures at locations where the channels intersect, the apertures fully penetrating through the abrasive layer.

9. The abrasive article of claim 1, wherein the channels travel along curved or undulating paths.

10. The abrasive article of claim 1, wherein the channels include any and all channels located on the working surface.

11. The abrasive article of claim 1, wherein the attachment layer comprises one half of a hook and loop attachment surface.

12. The abrasive article of claim 1, wherein the channels have a depth that is at least 90% of the overall thickness of the abrasive layer.

13. The abrasive article of claim 12, wherein the channels have a depth that exceeds the overall thickness of the abrasive layer such that the channels partially extend into the attachment layer.

14. A method of making an abrasive article comprising:

mounting a flexible abrasive layer having a working surface and a back surface onto a converting apparatus; and engraving a pattern of channels into the working surface of the abrasive layer to enhance the flexibility of the article, wherein the at least some of the channels intersect at intersection points and the act of engraving creates a plurality of apertures that fully penetrate through the article.

15. The method of claim 14, wherein the abrasive layer is coupled to an attachment layer that extends across at least a portion of the abrasive layer and at least some of the channels are engraved to a depth exceeding the thickness of the abrasive layer.

16. The method of claim 14, wherein the act of engraving comprises a laser cutting process.

17. The method of claim 14, wherein the act of engraving comprises a kiss cut die cutting process.

18. The method of claim 14, wherein the apertures are located where three channels intersect.

19. The method of claim 14, wherein the engraving of channels into the abrasive layer provides sufficient flexibility that the article shows a separation between opposing edges of 12 centimeters or less when subjected to the Drape Test.

* * * * *